US005543073A

United States Patent [19]

Adamy et al.

[11] Patent Number: 5,543,073

[45] Date of Patent: Aug. 6, 1996

[54] MICROEMULSION CLEANING COMPOSITION

[75] Inventors: Steven T. Adamy, Somerville; Barbara J. Thomas, Princeton, both of N.J.

[73] Assignee: Colgate-Palmolive Company, Piscataway, N.J.

[21] Appl. No.: 192,994

[22] Filed: Feb. 7, 1994

Related U.S. Application Data

[63] Continuation-in-part of Ser. No. 48,538, Apr. 14, 1993, abandoned.

[51] Int. Cl.[6] ..... C11D 17/00; C11D 3/43; C11D 3/50

[52] U.S. Cl. ..... 510/417; 510/365; 510/214; 510/238; 510/242; 510/244; 252/312

[58] Field of Search ..... 252/174, 174.11, 252/170, 171, DIG. 14, 174.21, 550, 551, 121, 122, 132

[56] References Cited

U.S. PATENT DOCUMENTS

| | | | |
|---|---|---|---|
| 4,022,699 | 5/1977 | Holm | 252/309 |
| 4,540,505 | 9/1985 | Frazier | 252/106 |
| 4,561,991 | 12/1985 | Herbots et al. | 252/118 |
| 5,035,826 | 7/1991 | Durbut et al. | 252/121 |
| 5,075,026 | 12/1991 | Loth et al. | 252/122 |
| 5,076,954 | 12/1991 | Loth et al. | 252/122 |
| 5,082,584 | 1/1992 | Loth et al. | 252/122 |
| 5,108,643 | 4/1992 | Loth et al. | 252/174.11 |
| 5,171,475 | 12/1992 | Freiesleben | 252/312 |

OTHER PUBLICATIONS

"Microemulsions", M. Kahlweit in Science, vol. 240, pp. 617–621, Apr. 29, 1988.

*Primary Examiner*—Paul Lieberman
*Assistant Examiner*—A. Hertzog
*Attorney, Agent, or Firm*—Richard E. Nanfeldt; Robert C. Sullivan; Murray Grill

[57] ABSTRACT

A microemulsion cleaning composition having superior solubilizing power and cleaning performance and low concentration of active ingredients has been developed which comprises an organic anionic surface active agent together with an optional nonionic surfactant, an electrolyte, alkylene glycol monoalkyl ether surfactant and water. The monoalkyl moiety of the alkylene glycol ether surfactant must have at least six carbon atoms.

14 Claims, 7 Drawing Sheets

MICROEMULSION CLEANING COMPOSITION

RELATED APPLICATION

This application is a continuation-in-part of application Ser. No. 8/048,538 filed Apr. 14, 1993, now abandoned.

FIELD OF THE INVENTION

This invention relates to microemulsion cleaning compositions having enhanced degrees of oil uptake and superior cleaning performance and in particular to cleaning compositions that leave lower surface residues following their use.

BACKGROUND OF THE INVENTION

Liquid detergent compositions in emulsion form have been employed as all-purpose detergents for cleaning hard surfaces, such as, painted woodwork, bathtubs, sinks, tile floors, tiled walls, linoleum, paneling and washable wallpaper. Taking advantage of the mechanism of soil removal by emulsification, microemulsions were developed as a more efficient method of removing lipophilic/materials from substrates. These microemulsions include a lipophile, a surfactant, a cosurfactant and water. They are a thermodynamically stable phase in which the micelles have a particle size of less than 100 nm (nanometers), are transparent with no Tyndall scattering and do not separate over long periods of time. Microemulsions can solubilize oil without the use of expensive hydrotropes or vigorous mixing. They show very low interfacial tensions with oil and so will spread on soil surfaces aiding cleaning.

Microemulsions have certain disadvantages which make their application to practical problems difficult and often unpredictable. For example, in order to apply this technology to a particular problem, it is necessary to determine the ternary phase diagram for said system. In addition careful consideration must be taken of the surfactant and cosurfactant to be used. Microemulsions are sensitive to electrolytes and the phase behavior of each system must be well understood when diluting it. They are sensitive to oil chain length and foaming at high concentrations of surfactant.

M. Loth et al in U.S. Pat. Nos. 5,075,026 and 5,082,584 disclosed an improvement in microemulsion compositions containing an anionic detergent, a cosurfactant, a hydrocarbon and water comprising the use of a water-insoluble odoriferous perfume as the essential hydrocarbon ingredient. The cosurfactants of this reference have substantially no ability to dissolve oily or greasy soil and are selected from the group consisting of, among other entities, water-soluble alkanols have 3 to 4 carbon atoms, polypropylene glycol ethers, and monoalkyl ethers and esters of ethylene glycol or propylene glycol having 1 to 4 carbon atoms.

M. Loth et al in U.S. Pat. No. 5,076,954 delineated a concentrated stable, microemulsion, cleaning composition comprising synthetic organic detergent, cosurfactant, water and water-insoluble perfume as an essential hydrocarbon ingredient in an amount sufficient to form a dilute oil-in water (o/w) microemulsion composition. The cosurfactants of this reference are selected from the group consisting of, among other compounds, water soluble alkanols, of 2 to 4 carbon atoms, polypropylene glycol of 2 to 18 propoxy units, a monoalkyl ether of a lower glycol of the formula $RO(X)_nH$ wherein R is $C_{1-4}$alkyl and X is $CH_2CH_2O$, $CH(CH_3)CH_2O$ or $CH_2CH_2CH_2O$ and n is from 1 to 4.

P. J. Durbut et al in U.S. Pat. No. 5,035,826 described a liquid detergent composition which in liquid crystal form comprises one or more nonionic detergents with lesser amounts of anionic or cationic surfactants, a cosurfactant, such as tripropylene glycol butyl ether, a solvent for the soil, such as, an isoparaffin (9–11 carbons) or methyl cocoate and water as the major component.

M. Loth et al in U.S. Pat. No. 5,108,643 described an aqueous microemulsion comprising an anionic and/or nonionic synthetic organic detergent, water-insoluble perfume, water and cosurfactant where the cosurfactant adjusts interfacial conformation to reduce interfacial tension between dispersed and continuous phases of said detergents, perfume and water and therefore produces a stable microemulsion. This composition does not contain any solvents for oils and greases other than the perfume.

M. Kahlweit reviewed the state of the art in the field of microemulsions in Science, Volume 240, pages 617–621, April (1988).

It is an object of this invention to provide microemulsion cleaning formulations which show higher degrees of oil uptake and superior cleaning performance when compared with systems representative of the prior art.

It is another object of this invention to provide microemulsion cleaning formulations which are effective with smaller amounts of active ingredients reducing the amounts of residues left after cleaning over that obtained using prior art systems.

Other objects will become apparent to those skilled in the art upon a further reading of the specification.

SUMMARY OF THE INVENTION

A microemulsion cleaning composition meeting the objects given above has been developed which comprises on a weight basis of the entire composition:

(a) from about 1 to about 40% of an anionic organic surface active agent;

(b) from 0 to about 40% of a nonionic organic surface active agent;

(c) from 0 to about 5% of an inorganic electrolyte;

(d) from about 1 to about 40% of a cosurfactant having the structure $RO(X)_nH$ where R is an alkyl radical having about 6 to about 9 carbon atoms, X is an ethoxy, propoxy or isopropoxy monovalent radical, wherein n is about 1 to about 4, more preferably 2 to 3; and (e) the remainder, sufficient water to bring the total composition to 100% by weight, wherein the composition additionally contains about 0.4 to 10 wt. % of a perfume.

It will be understood by those skilled in this art that the above-described composition may additionally contain as optional components such materials as dyes, perfumes, foam controllers, thickeners and the like. As used herein, the term "perfume" is used in its ordinary sense to refer to and include any non water-soluble fragrant substance or mixture of substances including natural (i.e., obtained by extraction of flower, herb, blossom or plant), artificial (i.e., a mixture of natural oils or oil constituents) and synthetic (i.e., a single or mixture of synthetically produced substance) odoriferous substances. Typically perfumes are complex mixtures of blends of various organic compounds, such as, esters, ketones, hydrocarbons, lactones, alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume. The precise composition of the perfume has no particular effect on cleaning performance so long as it meets the criteria of water immiscibility and pleasant odor. Although perfume is not, per se, a solvent for greasy or oily soil,—even though some perfumes may, in fact, contain as much as about 80% of terpenes which are known as good grease solvents—they have the capacity to enhance oil uptake in the compositions of this invention.

Another ingredient that may be optionally added to the composition of this invention is an inorganic or organic salt or oxide of a multivalent metal cation, particularly Mg++. The metal or oxide can provide several benefits including improved cleaning performance in dilute usage. Magnesium sulfate, either anhydrous or hydrated, is especially preferred as the magnesium salt. Other polyvalent metal ions that can also be used include aluminum, copper, nickel, iron and the like.

When inclusion of a foam suppressant in the claimed compositions is desired, minor amounts, i.e., from about 0.1% to about 2.0%, preferably from about 0.25% to about 1.0% by weight of the composition of a fatty acid or fatty acid soap having about 8 to about 22 carbon atoms can be incorporated.

Examples of the fatty acids which can be used as such or in the form of soaps include, distilled coconut oil fatty acids, "mixed vegetable" type fatty acids (e.g., those of high percentages of saturated, mono- and/or polyunsaturated C18 chains) oleic acid, stearic acid, palmitic acid, eicosanoic acid, and the like. Generally those fatty acids having from about 8 to about 22 carbon atoms therein are operative. The instant compositions do not contain any cationic, nonionic or anionic emulsifier surfactants such as those set forth at Column 8, line 16 to line 61 of U.S. Pat. No. 5,171,475, which is hereby incorporated by reference.

No specific mixing techniques or equipment are required for the preparation of these cleaning compositions. The order of mixing the various components is not narrowly critical and generally the various materials can be added to a suitable container sequentially or all at once with conventional agitators.

The temperatures used to prepare the claimed compositions and to clean products with them is not critical, ambient temperatures being sufficient. For removing oily soils or deposits from surfaces a range of about 5° to about 50° C. is preferred.

The range of pH of the composition is not critical and can be about 5.0 to about 9.0 or even from 2.0 to 13.0.

Although one can use from about 1 to about 40% of the range of anionic organic surface active agent, it is preferred to use about 3 to about 20% by weight. This is also the preferred range for nonionic surface active agent, when used.

The amount of cosurfactant employed is preferably about 1 to about 40% with a range of about 1 to about 15% being even more preferred.

The preferred electrolyte is sodium chloride but is not narrowly critical and so other metal salts can also be used. For example alkali metals, including potassium and lithium, alkaline earth metals, including barium, calcium and strontium and polyvalent metals, such as, aluminum, copper, nickel, iron and the like may be used with such anions as halides, sulfates, nitrates, hydroxides, oxides, acetates and the like. The preferred halide is chloride although bromide, iodide or fluoride can be used if desired. The preferred quantitative limits for the electrolytes is about 0 to about 5% with about 0 to about 1% being particularly preferred.

Suitable organic surface active agents include water-soluble, non-soap, anionic detergents as well as mixtures of said anionic detergents with water-soluble nonionic and polar nonionic detergents. Exemplary anionic detergents include those compounds which contain an organic hydrophobic group containing about 8 to about 22 carbon atoms and preferably about 10 to about 18 carbon atoms in their molecular structure and at least one water-solubilizing group, such as, sulfonate, sulfate or carboxylate. Usually, the hydrophobic group, will comprise a 8–22 carbon alkyl, alkenyl or acyl group. These detergents are employed in the form of water-soluble salts and the salt-forming cation is usually sodium, potassium, ammonium, magnesium, 2–3 carbon mono-, di- or tralkanolammonium cations.

Examples of anionic sulfate detergents are the 8–18 carbon alkyl sulfate salts and alkyl ether polyethenoxy sulfate salts having the formula $R(OC_2H_4)_nOSO_3M$ wherein R is an alkyl group having 8–18 carbon atoms, n is 1 to 12 and M is a solubilizing cation, e.g., sodium, potassium, ammonium, magnesium and mono-, di- and triethanol ammonium ions. The alkyl sulfate salts may be obtained by reducing glycerides of coconut oil or tallow and neutralizing the product with bases derived from metals in Groups I, II or III of the Deming Periodic Table. The alkyl ether polyethenoxy sulfates are obtained by sulfating the condensation product of ethylene oxide with an 8–18 carbon alkanol and neutralizing the product. Preferred alkyl sulfates and alkyl ether polyethenoxy sulfates contain about 10 to about 16 carbon atoms in the alkyl moiety. Particularly preferred alkyl sulfates are sodium lauryl sulfate and sodium myristyl sulfate.

When present, the water-soluble nonionic surfactants that are employed are the condensation product of an organic aliphatic or alkyl aromatic hydrophobic compound having a carboxy, hydroxy, amido or amino group with a free hydrogen attached to the nitrogen atom can be condensed with ethylene oxide or with the polyhydration product thereof, polyethylene glycol, to form a nonionic detergent. The length of the polyethenoxy chain can be adjusted to achieve the desired balance between the hydrophobic and hydrophilic elements (HLB) and such balances may be measured by HLB numbers.

Suitable nonionic surfactants are the condensation products of a higher alcohol containing about 8 to about 18 carbon atoms in a straight or branched chain configuration condensed with about 0.5 to 30 moles of ethylene oxide. Preferred compounds are a 9 to 11 carbon alkanol ethoxalate (5EO) and a 12 to 15 carbon alkanol ethoxalate (7EO). These preferred compounds are commercially available from Shell Chemical Co. under the tradenames, Dobanol 91-5 and Neodol 25-7.

Another group of suitable nonionic surfactants, sold under the tradename Pluronics, are condensation products of ethylene with the condensation products of propylene oxide and propylene glycol.

Other suitable surfactants are the polycondensation products of ethylene oxide and alkyl phenols, like nonyl phenol.

For the cosurfactants in this invention having the structure $RO(X)_nH$ where R, X and n are as defined above which are particularly useful over temperatures of about 5C and 43C wherein x is an alkylene or dialkylene group having 1 to 4 carbon atoms, more preferably 2 to 3 carbon atoms. Useful cosurfactants are: ethylene glycol monohexyl ether, ethylene glycol monoheptyl ether, ethylene glycol monooctyl ether, ethylene glycol monononyl ether, diethylene glycol monohexyl ether, diethylene glycol monoheptyl ether, diethylene glycol monooctyl ether, triethylene glycol monohexyl ether, propylene glycol monohexyl ether, isopropropylene glycol monohexyl ether and the like. These surfactants may be synthesized by condensing an alkanol having 6 to about 9 carbon atoms with ethylene oxide, 1,2-propylene glycol, or 1,3-propylene glycol respectively.

DETAILED DESCRIPTION OF THE INVENTION

Figure 1A:
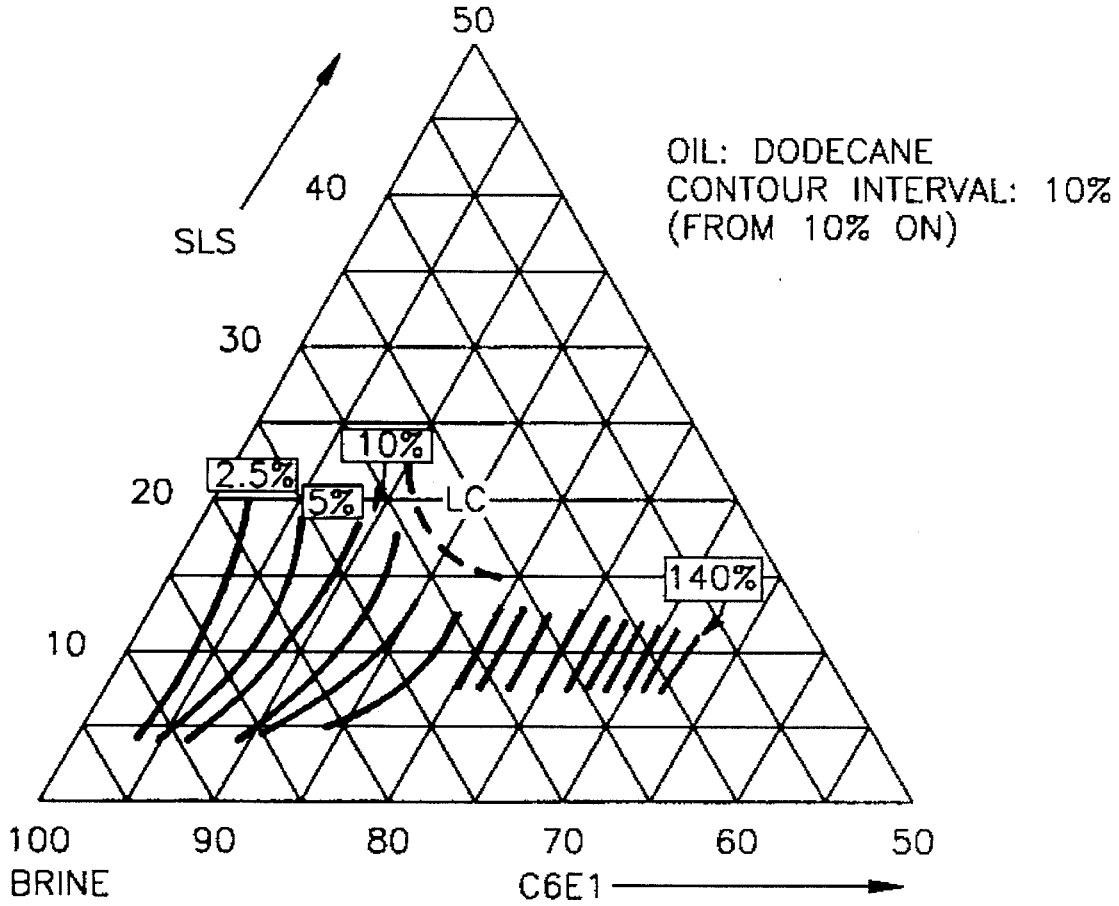
FIG. 1*a* is a ternary phase diagram showing dodecane uptake in a system containing ethylene glycol monohexyl ether (C6E1) as cosurfactant.

The invention is further described in the examples which follow. All parts and percentages are by weight unless otherwise specified.

EXAMPLE

The solubilizing power of systems employing ethylene glycol monohexyl ether (available as Hexyl Cellosolve from Union Carbide Chemicals and Plastics Co. Inc.) and diethylene glycol monohexyl ether (available as Hexyl Carbitol from Union Carbide Chemicals Co. Inc.) as cosurfactants were compared with systems employing ethylene glycol monobutyl ether (available as Butyl Cellosolve from Union Carbide Chemicals and Plastics Co. Inc.) and diethylene glycol monobutyl ether (available as Butyl Carbitol from Union Carbide Chemicals and Plastics Co. Inc.) using n-dodecane as the material being solubilized. Solubilization capacities for n-dodecane, i.e., the amount of n-dodecane which can be solubilized in a microemulsion so that the dispersion remains homogeneous, transparent and stable, were plotted in FIGS. 1*a–b* and 2*a–b*. The systems described are composed of 0.15M NaCl (aqueous) brine, sodium lauryl sulfate (as the surfactant SLS) and either ethylene glycol monohexyl ether (1a), diethylene glycol monohexyl ether (1b), ethylene glycol monobutyl ether (2a) or diethylene glycol monobutyl ether (2b). The n-dodecane solubilization capacities are shown in the form of contours of equal oil uptake plotted on the brine/SLS/cosurfactant triangular phase diagram. Note that FIGS. 1*a–b* and 2*a–b* represent partial phase diagrams, only going up to 50% SLS and 50% cosurfactant. The percentages shown on the contours were calculated from the equation:

$$\%\ \text{dodecane} = \frac{\text{mass dodecane} \times 100\%}{\text{mass sum of brine, } SLS \text{ and cosurfactant}} \quad (1)$$

Thus in FIG. 1*a*, the 2.5% contour lies on a composition point of 85% brine, 11% SLS and 4% ethylene glycol monohexyl ether (C6E1). This means that in 100 g of an 85% brine, 11% SLS, 4% C6E1, 2.5 g of dodecane may be solubilized before the mixture separates into two liquid phases.

Figure 1B:
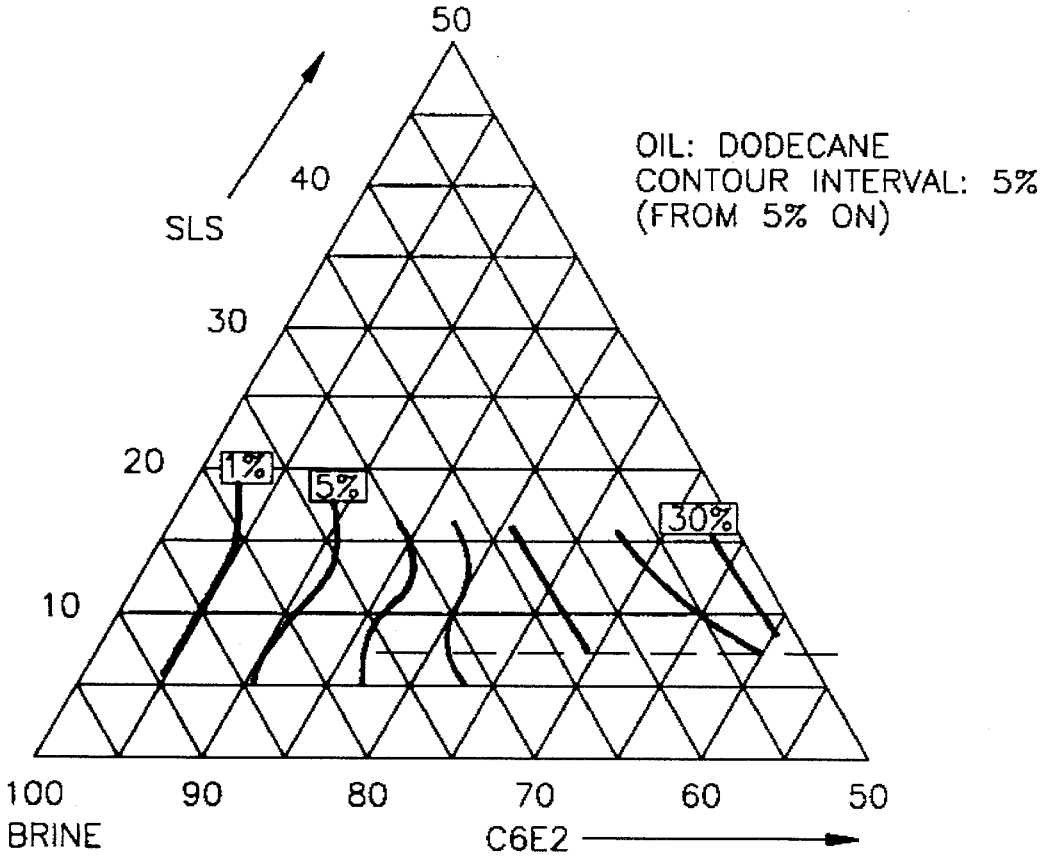
FIG. 1*b* is a ternary phase diagram showing dodecane uptake in a system containing diethylene glycol monohexyl ether (C6E2) as cosurfactant.
Figure 2A:
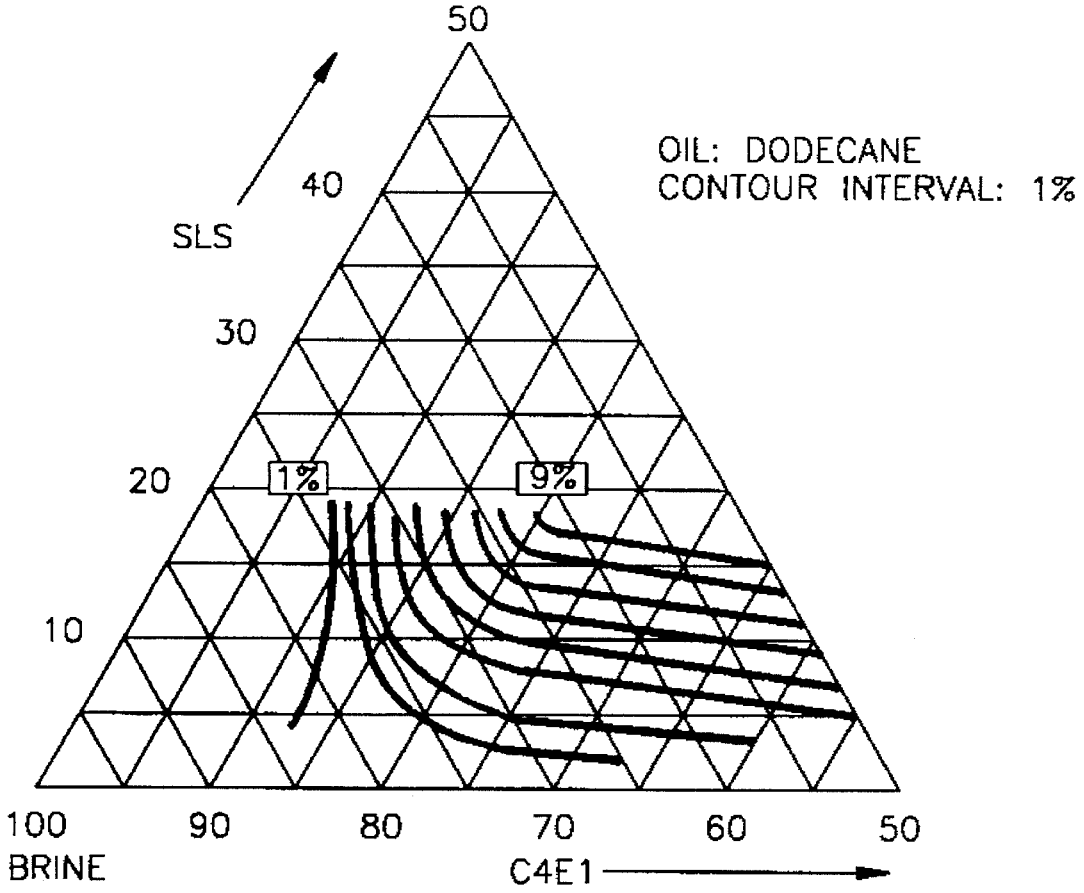
FIG. 2*a* is a ternary phase diagram showing dodecane uptake in a system containing ethylene glycol monobutyl ether (C4E1) as cosurfactant.
Figure 2B:
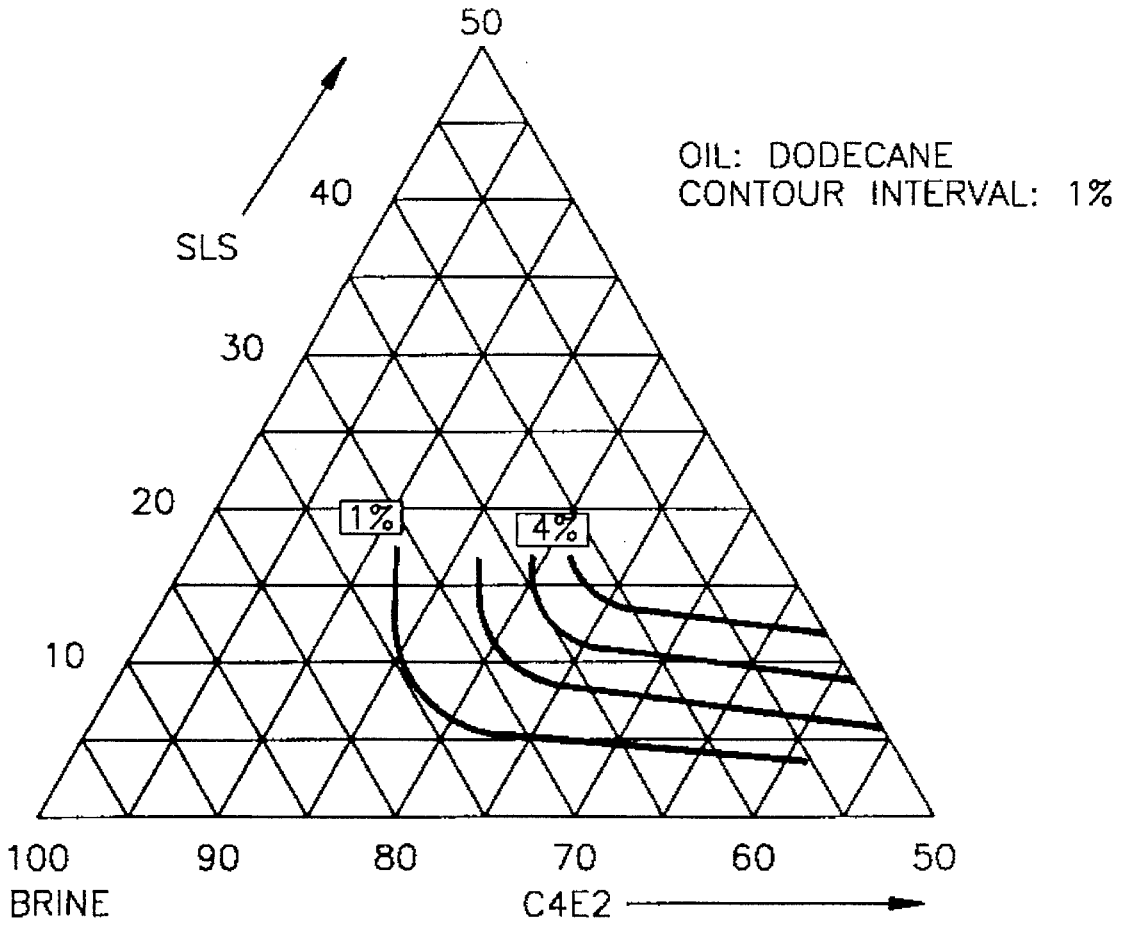
FIG. 2*b* is a ternary phase diagram showing dodecane uptake in a system containing diethylene glycol monobutyl ether (C4E2) as cosurfactant.

The superior solubilization performance of systems employing ethylene glycol monohexyl ether and diethylene glycol monohexyl ether over systems with ethylene glycol monobutyl ether and diethylene glycol monobutyl ether is demonstrated by comparing FIGS. 1*a* and 1*b* with 2*a* and 2*b*. For example, FIG. 1*a* shows that a composition of 90% brine, 5.0% SLS, and 5% ethylene glycol monohexyl ether can solubilize 5% dodecane; a composition with diethylene glycol monohexyl ether instead can solubilize 1% dodecane. Neither ethylene glycol monobutyl ether nor diethylene glycol monobutyl ether systems in like compositions were able to solubilize any significant amounts of dodecane. In more concentrated systems, having 12.5% SLS and 12.5% cosurfactant, the ethylene glycol monohexyl ether system can solubilize 6% dodecane. Like systems with ethylene glycol monobutyl ether and diethylene glycol monobutyl ether are able to solubilize only 2% and 1% dodecane, respectively.

The ability of a system to solubilize significant amounts of oil with lower concentrations of active ingredients is an improvement over prior art systems since less residue remains when such a system is used as a hard surface cleaner. The feature of less residue is further shown by analyzing the orientation of the uptake contours in FIGS. 1*a–b* and 2*a–b*. FIGS. 1*a* and 1*b* show that in the ethylene glycol monohexyl ether and diethylene glycol monohexyl ether systems, the contours are oriented largely towards the SLS-cosurfactant side. This means that oil solubilization is increased by increasing the amount of cosurfactant and not the amount of surfactant. Since the solubilization capacity can be increased by increasing the amount of the volatile component instead of a non-volatile surfactant, less residue is left on a hard surface. It is noted however, that the contour orientation may depend on the chain length of the oil.

It should also be noted that FIG. 1*a* shows that at high levels of surfactant, cosurfactant and dodecane, liquid crystals are formed.

EXAMPLE 3

Figure 3:
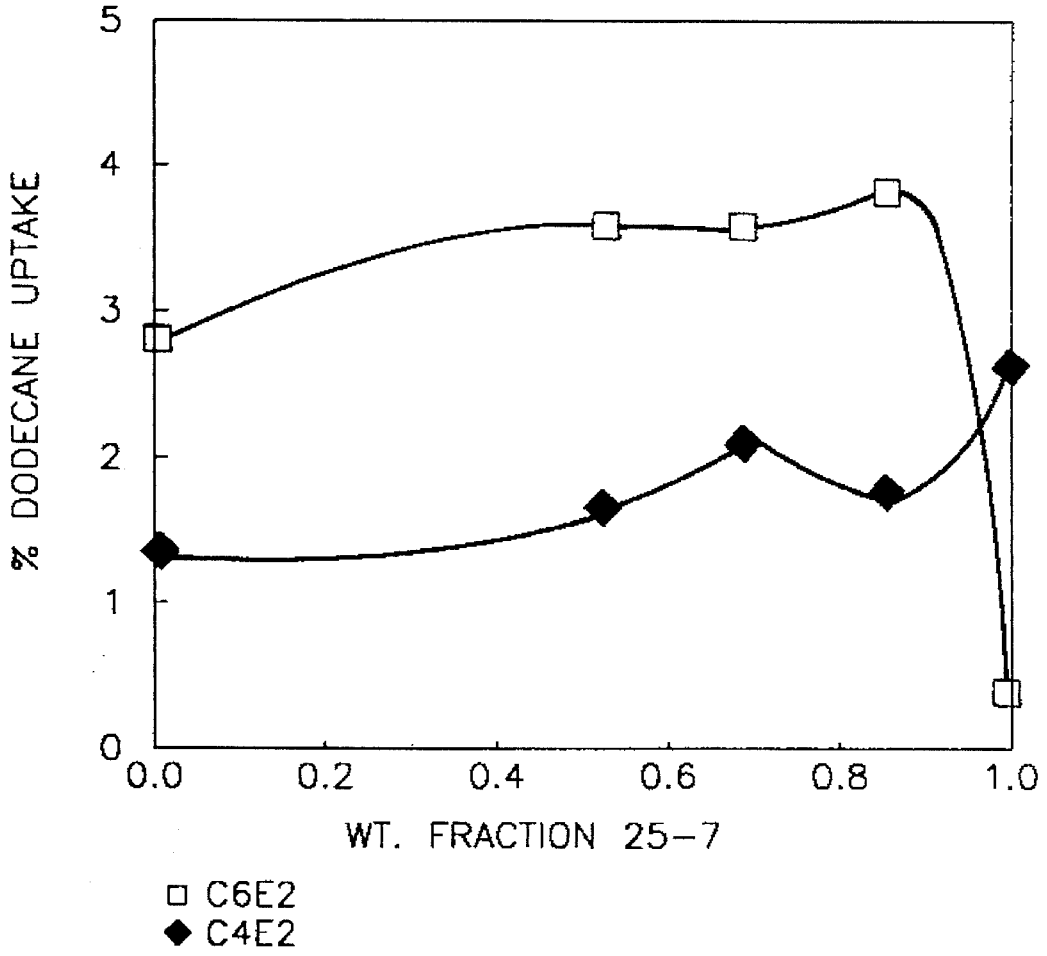
FIG. 3 is a two dimensional graph showing dodecane uptake in a system containing either diethylene glycol monohexyl (C6E2) or monobutyl ether (C4E2) as cosurfactant with a mixture of anionic and nonionic surfactants.

FIG. 3 shows the dodecane uptake capacity of a system containing diethylene glycol monohexyl ether compared with a system containing diethylene glycol monobutyl ether. In both cases, a mixture of Mg lauryl sulfate and Neodol 25-7 (a straight chain nonionic surfactant with 12–15 carbon atoms and 7 ethoxy groups, available from Shell Chemical Co.) was used at a total concentration of 6%. The weight fraction of the Neodol 25-7 was varied from 0 to 1. The cosurfactant, diethylene glycol monohexyl ether or diethylene glycol monobutyl ether was kept constant at 3%. Perfume was added at a level of 0.8% in order to form the microemulsion. Except at very high weight fractions of Neodol 25-7, the dodecane uptake was significantly higher for diethylene glycol monohexyl ether as cosurfactant than for diethylene glycol monobutyl ether, the oil solubility being nearly doubled.

EXAMPLE 3

The solubilizing performance of the ethylene glycol monohexyl ether and diethylene glycol monohexyl ether systems was next compared with ethylene glycol monobutyl ether and diethylene glycol monobutyl ether where triolein is the oil to be solubilized. In these examples, microemulsions were preformed with dodecane as a solubilized hydrocarbon and uptake capacities of triolein in these systems measured. However, triolein uptake in systems without dodecane has also been measured.

Figure 4:
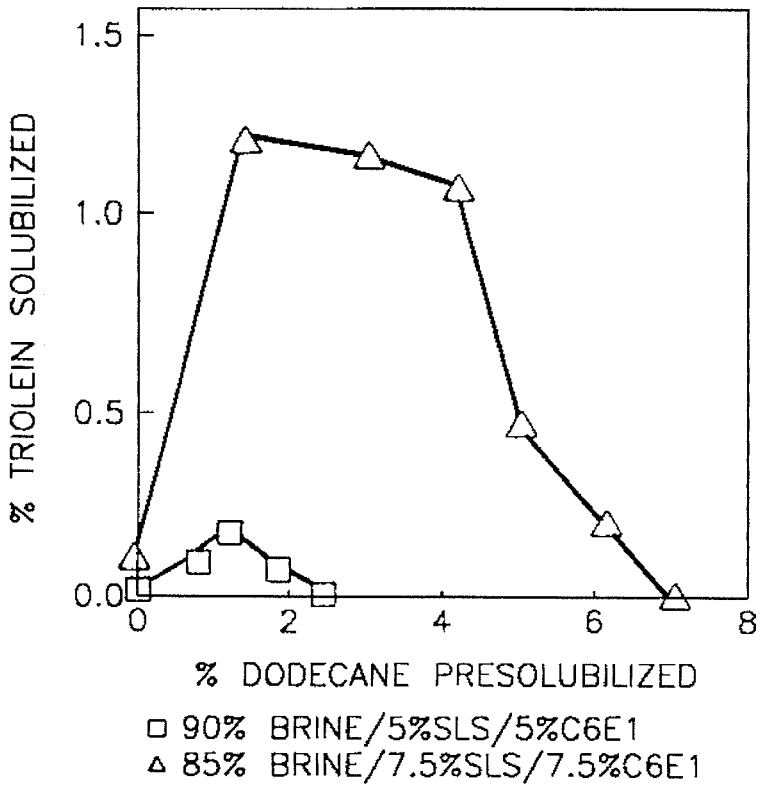
FIG. 4 is a two dimensional graph showing triolein uptake as a function of the amount of dodecane solubilized in an ethylene glycol monohexyl ether (C6E1) system.
Figure 5:
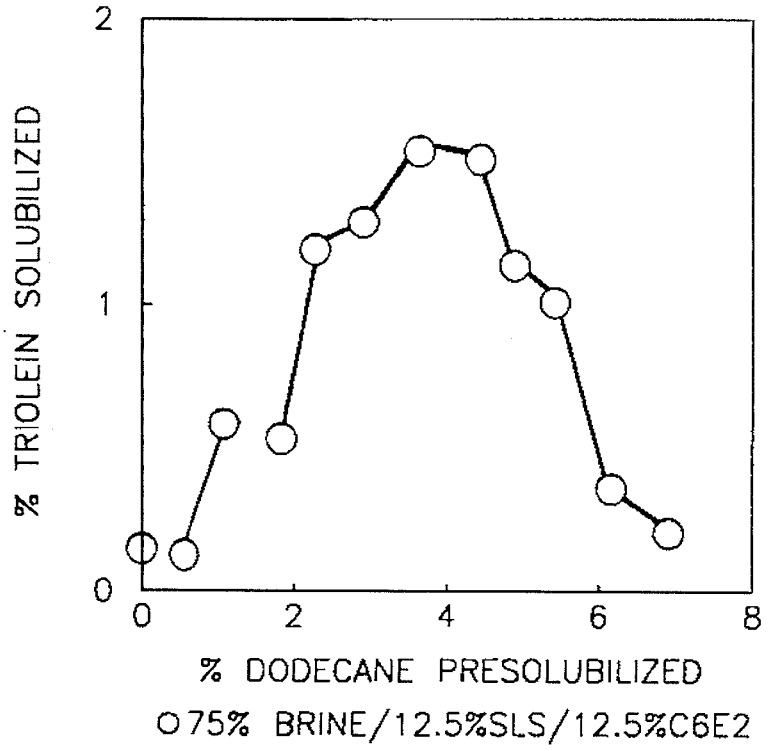
FIG. 5 is a two dimensional graph showing triolein uptake as a function of the amount of dodecane solubilized in a diethylene glycol monohexyl ether (C6E2) system.

FIGS. 4 and 5 show triolein uptake in two-example ethylene glycol monohexyl ether systems as a function of the amount of dodecane solubilized. The amount of dodecane is represented as a percentage calculated by equation (1) given above. The amount of triolein solubilized was calculated by the equation:

$$\%\ \text{triolein} = \frac{\text{mass triolein solubilized} \times 100\%}{\text{mass sum brine, } SLS\text{, cosurfactant + dodecane}} \quad (2)$$

FIG. 4 shows that in a composition of 5% of SLS, 5% ethylene glycol monohexyl ether, 90% brine with 1.4% dodecane solubilized (as defined in Equation 1), 0.14% triolein (as defined by Equation 2) may be solubilized. FIG. 4 also shows that with a higher concentration of active ingredients–7.5% each of SLS and ethylene glycol monohexyl ether, 85% brine with 1.4% dodecane solubilized= 1.26% triolein may be solubilized. FIG. 5 shows that triolein uptake in the diethylene glycol monohexyl ether system, where a composition of 12.5% SLS, 12.5% diethylene glycol monohexyl ether, 75% brine can solubilize a maximum of 1.55% triolein when 3.6% dodecane is presolubilized. In systems employing ethylene glycol monobutyl ether or diethylene glycol monobutyl ether, NaCl brine, and SLS with compositions in the ranges specified in FIGS. 4 and 5, no significant triolein uptake was measured. The fact that the systems employing ethylene glycol monohexyl ether and diethylene glycol monohexyl ether were able to solubilize significant quantities of triolein, while those with ethylene glycol monobutyl ether and diethylene glycol monobutyl ether cannot solubilize any triolein, attests to the superior performance of the ethylene glycol monohexyl ether and diethylene glycol monohexyl ether systems.

EXAMPLE 4

In order to test grease cleaning performance, two prototype all-purpose cleaner formulations were prepared and are shown below in Table 1 as compositions A and B.

TABLE 1

Composition of Formulas Tested

| Material | A | B |
|---|---|---|
| Mg Lauryl Sulfate | 3.0 | 3.0 |
| Neodol 25-7 | 3.0 | 3.0 |
| Diethylene glycol mono butyl ether | 3.0 | |
| Diethylene glycol mono hexyl ether | | 3.0 |
| Perfume | 0.8 | 0.8 |
| Water | q.s. | q.s. |

Figure 6:
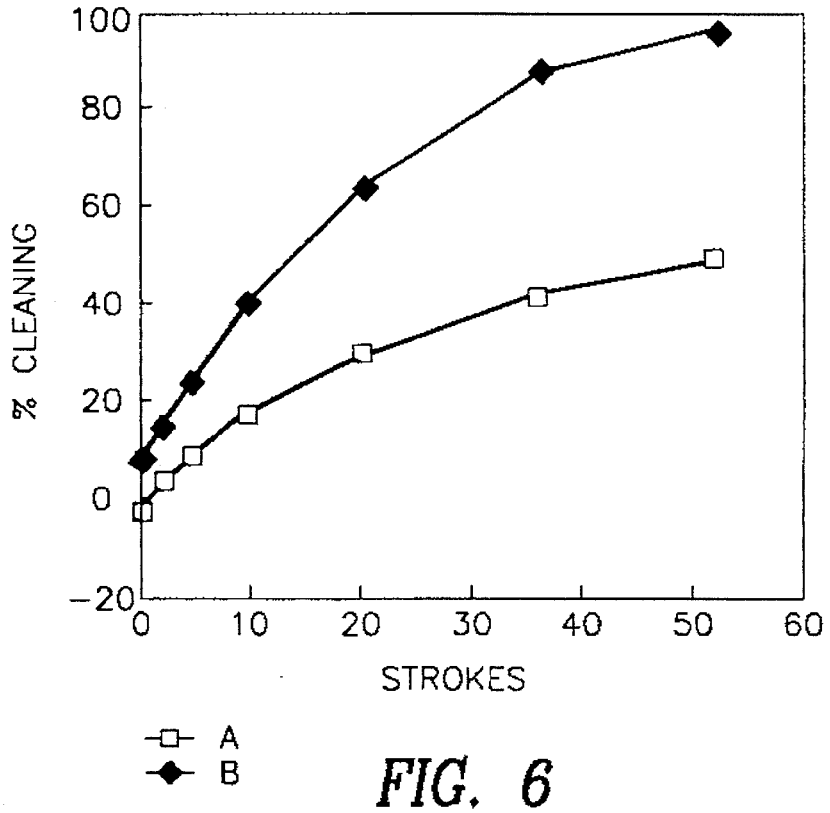
FIG. 6 is a two dimensional graph showing neat grease cleaning of two prototype microemulsions.
Figure 7:
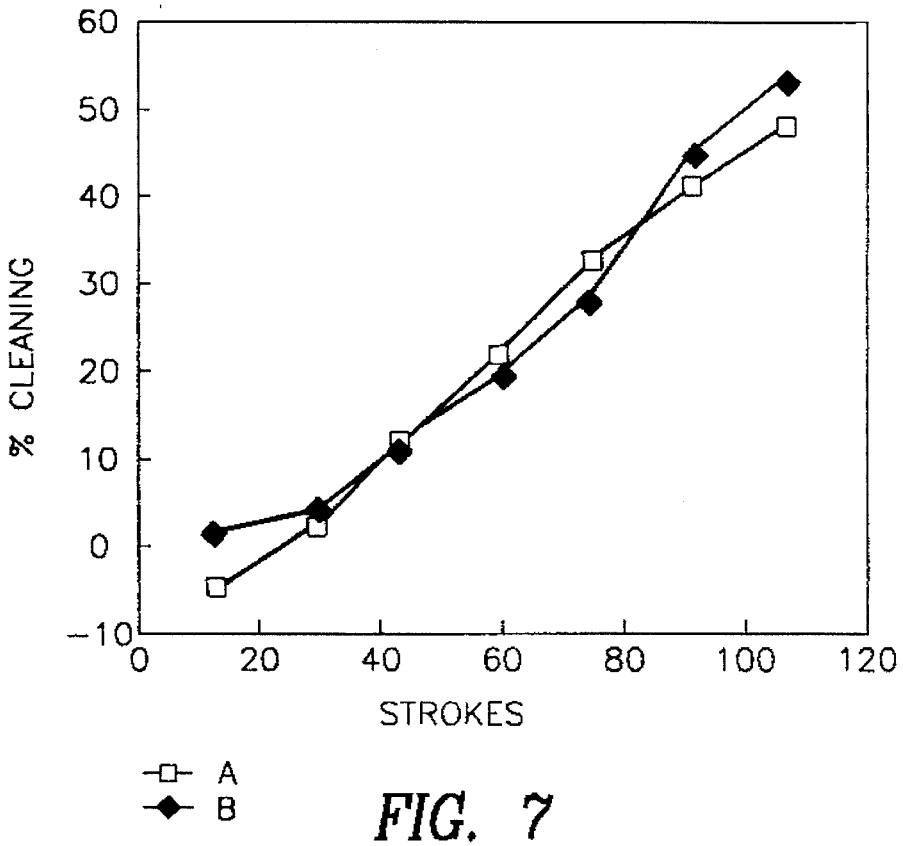
FIG. 7 is a two dimensional graph showing grease cleaning with diluted microemulsions.

FIGS. 6 and 7 show a comparison of the grease cleaning ability of formulae A and B when used neat (undiluted) and diluted. When used neat, Formula B, containing diethylene glycol monohexyl ether, cleans significantly faster than formula A. When diluted, both formulae perform equally well. Thus, when used as a cosurfactant, diethylene glycol monohexyl ether shows enhanced grease cleaning on neat application and equal cleaning upon dilution when compared with diethylene glycol monobutyl ether.

CLEANING PROCEDURE

A mixture of 50% hard tallow and 50% soft tallow dyed with D&C Red #17 was applied to new Formica tiles (15cm×15cm) by spraying a chloroform solution with an air brush. For the Neat test, a 10% solution of the grease was used while for dilute, a 2% solution was used. In both cases, a 0.01% solution of the dye was used. For Neat cleaning, 1.0% of each formula was applied to sponges which were previously saturated with tap water and wrung out. For diluted cleaning, sponges were saturated with 1.2% solutions of the formulae in tap water. The sponges were placed in holders and placed on a sled of a Gardner Abrader apparatus. Each sponge holder contained 270 g of lead shot. The abrader was allowed to operate for the desired number of strokes and the percent reflectance of the tile was measured. For neat, the operation was continued stopping after 1,3, 5, 10, 20, 35 and 50 strokes. For dilute, the sponges and holders were removed after every 15 strokes so that the sponges could be wrung out and replenished with solution.

The % cleaning was calculated according to the following ratio:

$$\frac{\text{Cleaned tile reflectance} - \text{soiled tile reflectance}}{\text{Unsoiled tile reflectance} - \text{soiled tile reflectance}} \times 100$$

An average of three readings was used for each test.

Although the invention has been described with a certain amount of particularity, it is understood that the present disclosure of the preferred forms has been made only by way of example and that numerous changes can be resorted to without departing from the spirit and the scope of the invention.

What is claimed is:

1. A microemulsion cleaning composition having superior solubilizing power and cleaning performance and low concentration of active ingredients which comprises on a weight basis of the entire composition:

(a) from about 3 to about 20% of an anionic organic surface active agent which is selected from the group consisting of $C_8$-$C_{18}$ alkyl sulfate salts and alkyl ether polyethenoxy sulfate salts;

(b) from 0 to about 40% of a nonionic surface active agent;

(c) from 0 to about 5% of an inorganic electrolyte;

(d) from about 1 to about 15% of a cosurfactant having the structure $RO(X)_nH$ where R is an alkyl radical having 6 carbon atoms, X is an ethoxy, propoxy or isopropoxy monovalent radical, wherein n is about 1 to about 4;

(e) 0.4% to 10% of a perfume; and (f) the balance being water.

2. The composition claim in claim 1 wherein the anionic surface active agent is an alkyl sulfate salt having about 8 to about 18 carbon atoms in the alkyl moiety and the salt is derived from a metal in Groups I, II or III of the Deming Periodic Table.

3. The composition claimed in claim 2 wherein the alkyl sulfate salt is sodium lauryl sulfate.

4. The composition claimed in claim 2 wherein the alkyl sulfate salt is magnesium lauryl sulfate.

5. The composition claimed in claim 1 wherein the nonionic organic surface active agent is a condensation product of ethylene oxide and a higher alcohol having about 8 to about 18 carbon atoms.

6. The composition claimed in claim 5 wherein the condensation product is derived from about 5 to 7 ethylene oxide units and the higher alcohol has about 9 to about 15 carbon atoms.

7. The composition claimed in claim 1 wherein the electrolyte is an alkali metal or alkaline earth metal salt.

8. The composition claimed in claim 7 wherein the alkali metal is sodium.

9. The composition claimed in claim 7 wherein the alkali earth metal is magnesium.

10. The composition claimed in claim 7 wherein the salt is a halide or sulfate.

11. The composition claimed in claim 1 wherein the cosurfactant is ethylene glycol monohexyl ether.

12. The composition claimed in claim 1 wherein the cosurfactant is diethylene glycol monohexyl ether.

13. The composition claimed in claim 1 wherein the composition additionally contains about 0.1 to 2.0 wt. % of a foam suppressant.

14. The composition claimed in claim 13 wherein the foam suppressant is a fatty acid or fatty acid soap having about 8 to 22 carbon atoms.

* * * * *